US007380356B2

(12) United States Patent
Baboz et al.

(10) Patent No.: US 7,380,356 B2
(45) Date of Patent: Jun. 3, 2008

(54) APPARATUS AND METHOD FOR LOADING FLAT ARTICLES OF CLOTHING INTO A LAUNDRY PROCESSING UNIT

(75) Inventors: Nicolas Baboz, Gresy-sur-Aix (FR); Manuel Gorriz, Gresy-sur-Aix (FR)

(73) Assignee: Societe Jean Michel, Gresy-sur-Aix ( * ) Notice: Subject to any disclaimer, the term of this patent is extended or adjusted under 35 U.S.C. 154(b) by 0 days.

(21) Appl. No.: 11/401,122

(22) Filed: Apr. 10, 2006

(65) Prior Publication Data

US 2007/0000158 A1 Jan. 4, 2007

(30) Foreign Application Priority Data

Oct. 10, 2003 (WO) ..... PCT/ES03/00515
Oct. 10, 2003 (WO) ..... PCT/ES03/00516

(51) Int. Cl.
*D06F 67/04* (2006.01)
*D06F 69/00* (2006.01)

(52) U.S. Cl. ..... 38/143

(58) Field of Classification Search ..... 38/141, 38/143, 144, 7–12
See application file for complete search history.

(56) References Cited

U.S. PATENT DOCUMENTS 3,664,046 A * 5/1972 Thompson ..... 38/143
3,911,604 A * 10/1975 Sjostrom ..... 38/143
5,416,991 A * 5/1995 Jensen ..... 38/143
5,440,810 A 8/1995 Borucki et al.
5,815,963 A * 10/1998 Rauch et al. ..... 38/143

FOREIGN PATENT DOCUMENTS

| | | | |
|---|---|---|---|
| EP | 0 554 205 A1 | | 8/1993 |
| GB | 2 098 633 A | | 11/1982 |
| GB | 2221226 | * | 1/1990 |
| JP | 2002-326000 | | 11/2002 |

OTHER PUBLICATIONS

International Search Report for PCT Application No. PCT/ES2003/000516 mailed Jul. 5, 2004.

* cited by examiner

*Primary Examiner*—Ismael Izaguirre
(74) *Attorney, Agent, or Firm*—RatnerPrestia

(57) ABSTRACT

An apparatus and method for loading flat articles of clothing into a laundry processing unit is disclosed. The apparatus comprises a frame having an entrance opposite an end of a conveyor belt, at least one loading post controlled by an operator, with a first pair of clamps for an article of clothing, and a device for lifting the clamps until the article is transferred to a second pair of clamps associated with a spreader, including a pivoting arm supporting clamps connected to a slide slidably mounted on a tilted guide rail and rotation driving means of arm and translation driving means of slide serve to move clamps in a combined translation and rotation trajectory. The apparatus comprises further features adapted to produce relative movements and to adopt different positions with respect to frame in order to provide at least one operating mode and at least one transport mode.

29 Claims, 8 Drawing Sheets

APPARATUS AND METHOD FOR LOADING FLAT ARTICLES OF CLOTHING INTO A LAUNDRY PROCESSING UNIT

FIELD OF THE INVENTION

This invention relates to an apparatus for loading flat articles of clothing into a laundry processing unit, such as an ironing or folding machine, flat clothing being understood to mean table and household linen, and hospital and catering linen etc., such as table cloths, napkins, sheets, towels, and others. This invention also relates to a loading method that can be implemented using the above apparatus.

BACKGROUND

In laundry processing plants, processing units such as ironing and folding machines for clothing are used, into which the flat articles of clothing must be introduced in a spread out condition on a mobile conveyor belt. In the prior art apparatuses are known for loading flat articles of clothing into such laundy processing units.

Patent EP-A-0554205 describes one of such loading apparatuses, including a frame with an entrance opposite one reception end of a conveyor belt and one or more loading posts located in front of said entrance. Each loading post is controlled and served by an operator, and includes a first pair of clamps in which said operator can catch the ends of a flat article of clothing, and lifting means adapted to move said first pair of clamps, with the article of clothing hanging down, to a higher position in which the first pair of clamps transfers the ends of the flat article of clothing to a second pair of clamps associated with spreading out means mounted on the frame. Said spreading out means include a pair of carriages running on respective guide rails extending above and next to the reception end of the conveyor belt transverse to the transport direction thereof. Each clamp in said second pair of clamps is mounted on one respective carriage of said pair of carriages, and driving means are configured and arranged to move each carriage independently, separating them from one another, between positions in front of the loading post, where the transfer took place, and suitable positions with respect to the centre of the conveyor belt in order to spread out the flat article of clothing sufficiently. In this position, the flat article of clothing is held by the top ends thereof by the second pair of clamps and hangs down vertically. Blowing and suction means help to place one end of the flat article of clothing spread out over said reception end of the conveyor belt at the same time as the scond pair of clamps release the article. In the lifting means, the trajectory of the said movement of said first pair of clamps to a higher position is a tilted rectilinear trajectory, with a loading end positioned at a lower level and more external that the opposite transfer end. In other words, both clamps in the first pair of clamps simultaneously carry out translation movements along parallel trajectories from the loading position to the transfer position and subsequently translation movements in the opposite direction upon returning to the loading position.

The arrangement described in said patent EP-A-0554205, at the time, represented an advantage because the operators did not need to lift the flat articles of clothing to catch them directly in the second pair of clamps, but instead they catch them on the first pair of clamps and the lifting means produce the lift. However, this arrangement can be improved in terms, for example, of the implementation speed of the lifting means and the ergonomy of the loading posts.

JP-200232600 describe a cloth conveyor assembly capable of streching and conveying large clothers such as sheets and small clothes such as pillows cases and napkins. A front wall of a suction chamber is installed provided with vertically displaceable grips so that it can be moved between a use position wherein it projects form a front end of a hand-operating conveyor to a clothes feeding operation position and a storage position wherein it moves back to the inside of the front end of said hand operating conveyor. The reduction of volume obtained between these two positions only provides a longitudinal reduction but a height reduction is not obtained. This document does not disclose one of said two referred positions being apt to provide a transport mode of the apparatus, with a reduced global volume.

DISCLOSURE OF THE INVENTION

An exemplary embodiment of this invention provides an apparatus and a method for loading flat articles of clothing into a laundry processing unit including the above-mentioned improvements regarding speed and ergonomic design.

Another exemplary embodiment of this invention provides a modular apparatus for loading flat articles of clothing into a laundry processing unit including advantages with regard to speed, ergonomy desing and versatility.

The above advantages are achieved according to a first aspect of this invention by providing an apparatus for loading flat articles of clothing into a laundry processing unit, such as an ironing or folding machine, of the type including a frame having an entrance opposite one reception end of a conveyor belt, at least one loading post controlled by an operator, with a first pair of clamps in which said operator can catch the ends of a flat article of clothing, and lifting means adapted to move said first pair of clamps to a higher position in which the flat article of clothing is transferred to a second pair of clamps associated with spreading out means including at least one pair of carriages running along respective guide rails transverse to the transport direction of said conveyor belt, each clamp in said second pair being mounted on a respective carriage of said pair of carriages, driving means being arranged to move each carriage in said pair of carriages independently, separating them from one another, between positions in front of the loading post, of which there is at least one, and suitable positions with respect to the centre of the conveyor belt to place one end of the flat, article of clothing stretched out on said reception end of the conveyor belt with the help of blowing means. The apparatus is characterised in that said lifting means for moving said first pair of clamps in the loading post include at least one pivoting arm supporting at one end the first pair of clamps and which is connected at the other end in a pivoting manner to a slide slidably mounted on one or more rectilinear guide rails having one end higher than the other, rotating driving means for the pivoting arm and translation driving means for the slide being arranged and adapted to move the first pair of clamps in a combined translation and rotation trajectory.

The apparatus also includes a suction device having a suction mouth adjacent to a lower part of the reception end of the conveyor belt to attract the flat article of clothing by means of a suction jet towards said reception end of the conveyor belt and towards a longitudinal roller located next to a lower edge of said suction mouth. Said longitudinal roller is driven to rotate at a relatively high speed so as to cooperate with the suction device and quickly drag the hanging part of the article of clothing into a box of the device from where the article of clothing is dragged by the conveyor belt while mobile brushes moving longitudinally in divergent directions next to the suction mouth remove any possible wrinkles from the article of clothing.

Moreover various operating systems of the apparatus are grouped in different modules mounted on respective chassis adapted to produce relative movements and to adopt different positions with respect to the frame in order to provide at least one operating mode, suitable for loading articles of clothing, and at least one transport mode, suitable for providing an overall reduced volume appropriate for transporting the apparatus. In particular, said transport mode provides the apparatus with a suitable volume for being packaged in a box of degradable or reuseable material, such as wood, appropriate for being introduced into a standard container.

According to another aspect of this invention a method is provided for loading flat articles of clothing into a laundry processing unit, such as an ironing or folding machine, by means of an apparatus according to the invention including an entrance opposite a reception end of a conveyor belt. The method includes the conventional steps of: manually catching the ends of a flat article of clothing in a first pair of clamps arranged in at least one loading post controlled by an operator; moving said first pair of clamps towards a higher position using lifting means associated with said loading post; transferring the flat article of clothing to a second pair of clamps associated with spreading out means including at least one pair of carriages running on respective guide rails transverse to the transport direction of said conveyor belt, each clamp in said second pair of clamps being mounted on one respective carriage of said pair of carriages; spreading out the flat article of clothing by means of the independent movement, produced by driving means, of the pair of carriages, separating them from one another, between positions in front of the loading post, of which there are at least one, and symmetrical positions with respect to the centre of the conveyor belt; and placing one end of the flat article of clothing spread out on said reception end of the conveyor belt with the help of blowing means. The method of the invention is characterised in that the said step of moving the first pair of clamps to a higher position using said lifting means includes moving the first pair of clamps in a combined translation and rotation trajectory by means of at least one rotation, produced by rotation driving means, of at least one pivoting arm supporting at one ends the first pair of clamps, and at least one translation, pproduced by translation means, of a slide slidably mounted on rectilinear guide rails and to which the pivoting arm is connected at its other end.

The combined translation and rotation trajectory of the first pair of clamps allows a greater overall movement of the first pair of clamps than with just a translation or just a rotation movement, whereby the loading position is further away from the transfer position and therefore further away from the reception end at the entrance to the frame. Also, the greater movement of the combined trajectory can be produced proportionally more quickly than an equivalent movement with just translation.

Also, the combined translation and rotation trajectory allows the first pair of clamps to go beyond the second pair of clamps immediately after transferring the flat article of clothing so that the second pair of clamps start to move without having to wait for the first pair of clamps to return to the loading position, which means an additional saving in time. Also, the combined translation and rotation trajectory means that the first pair of clamps support the article of clothing in a raised waiting position, after the translation and before the rotation, so that the article of clothing remains uninfluenced by the suction device associated with the conveyor belt.

BRIEF DESCRIPTION OF THE DRAWINGS

The above and other characteristics and advantages will be better understood from the following detailed description of an exemplary embodiment with reference to the attached drawings, in which.

DETAILED DESCRIPTION OF AN EXEMPLARY EMBODIMENT

Figure 1:
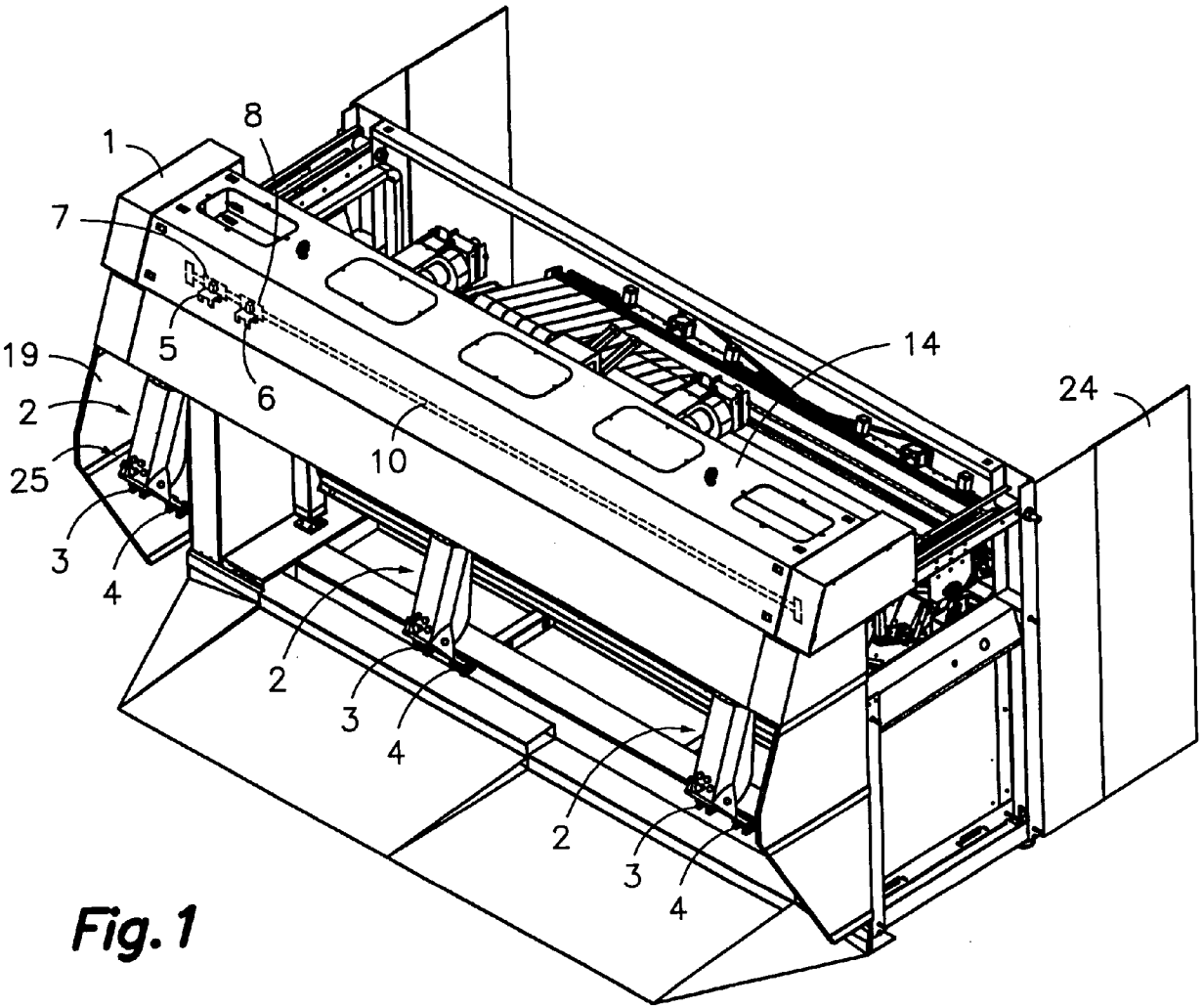
FIG. 1 is a perspective view of the apparatus according to this invention.

With reference first of all to FIG. 1, the apparatus for loading flat articles of clothing into a laundy processing unit, such as an ironing or folding machine, is shown, according to this invention. The apparatus includes a frame 1 with an entrance opposite a reception end 31 of a conveyor belt 30 (see also FIGS. 2, 4 and 5).

In the area of said entrance there are three loading posts 2, each one of which is prepared to be controlled and served by an operator. It should be noted, however, that although in the illustrated example the apparatus includes three loading posts, the apparatus and method according to this invetion can include one, two, three or more loading posts. Each loading post 2 includes a first pair of clamps 3, 4 in which the corresponding operator can catch adjacent ends of a flat article of clothing. Lifting means associated with each loading post 2 are adapted to move said first pair of clamps 3, 4, with the article caught in said clamps, to a higher position in which the flat article of clothing is transferred to a second pair of clamps 5, 6 associated with spreading out means (shown in dotted lines in FIG. 1) including at least one pair of carriages 7, 8 running on respective guide rails 9, 10 placed above or near reception end 31 of conveyor belt 30, and tranverse to the transport direction thereof. Each clamp 5, 6 is mounted on one respective carriage of said pair of carriages 7, 8, and driving means are arranged to independently move each carriage 7, 8 and respective second clamps 5, 6 along their respective guide rail 9, 10. This movement is produced under the guidance of an electronic control programmed to move second clamps 5, 6, in which respective ends of the article of clothing transferred from the first pair of clamps 3, 4, are caught, separating them from one another, between positions in front of the loading post 2 in question, where the transfer takes place, and suitable positions with respect to the centre of conveyor belt 30, so that the article of clothing is spread out and hung vertically. From this position, a top end of the flat article of clothing is then spread out on said reception end 31 of conveyor belt 30 with the help of conventional blowing and suction means including a bar 61 mounted on pivoting arms and provided with suction holes and a endstop bar 62 mounted on pivoting arms and provided with blowing nozzles.

Although in the example illustrated in the figures, the apparatus includes only one pair of guide rails for a single second pair of clamps, according to this invention it would be possible to include two or more pairs of guide rails for an equal number of pairs of second clamps adapted for independently serving different loading post units.

In the apparatus of this invention, the various operating systems are grouped in different modules mounted on respective chassis adapted to produce relative movements and to adopt different positions with respect to the frame 1 in order to provide at least one operating mode, suitable for loading articles of clothing, and at least one transport mode, suitable for providing an overall reduced volume appropriate for transporting the apparatus. This way, at least loading posts 2 and spreading out means 5, 6, 7, 8 are contained in one module; the conveyor belt 30 together with its driving means are contained in another module, a suction device 50 is contained in another module; and an exit conveyor belt 40 together with its driving means form yet another module. The modules respectively forming conveyor belt 30 and suction device 50 are adapted to attach mutually acting as a combined module in some operating modes, as explained below.

As shown in FIGS. 3A-3D, one characteristic of this invention is that the said lifting means arranged to move said first pair of clamps 3, 4 in loading post 2 include a pivoting arm 11 supporting at one end the first pair of clamps 3, 4. Said arm 11 is connected in a pivoting manner at the other end to a slide 12 slidably mounted on one or more rectilinear guide rails 13, generally tilted, with one end being higher than the other. The lifting means include rotation driving means for rotating pivoting arm 11 in both directions with respect to slide 12 and translation driving means for moving slide 12 along guide rails 13 in both directions. This way, the rotation and translation driving means are adapted to move the first pair of clamps 3, 4 in a combined translation and rotation trajectory.

Figure 3A:
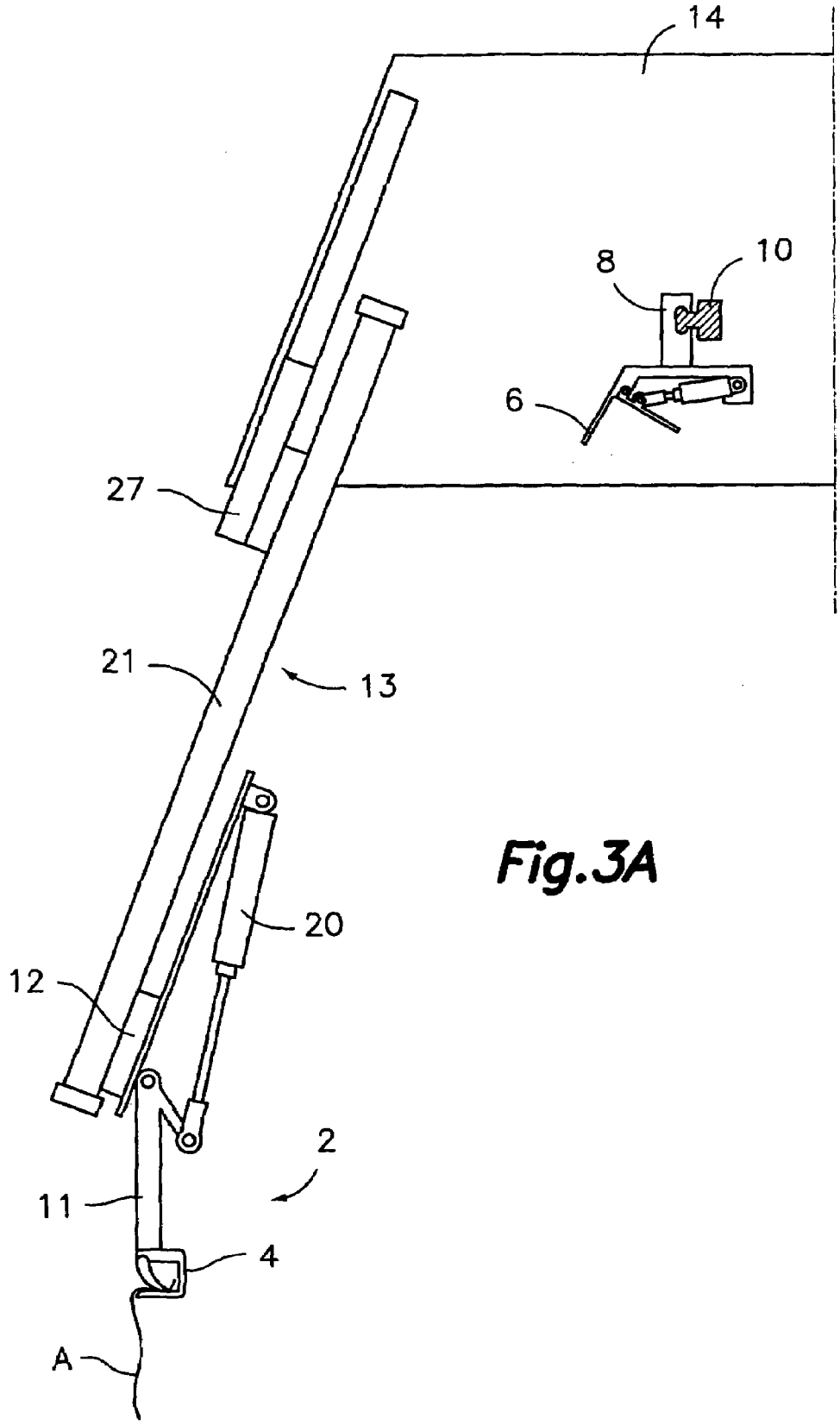
FIGS. 3A-3D are schematic side views showing a sequence of an operating cycle of the lifting means.
Figure 3B:
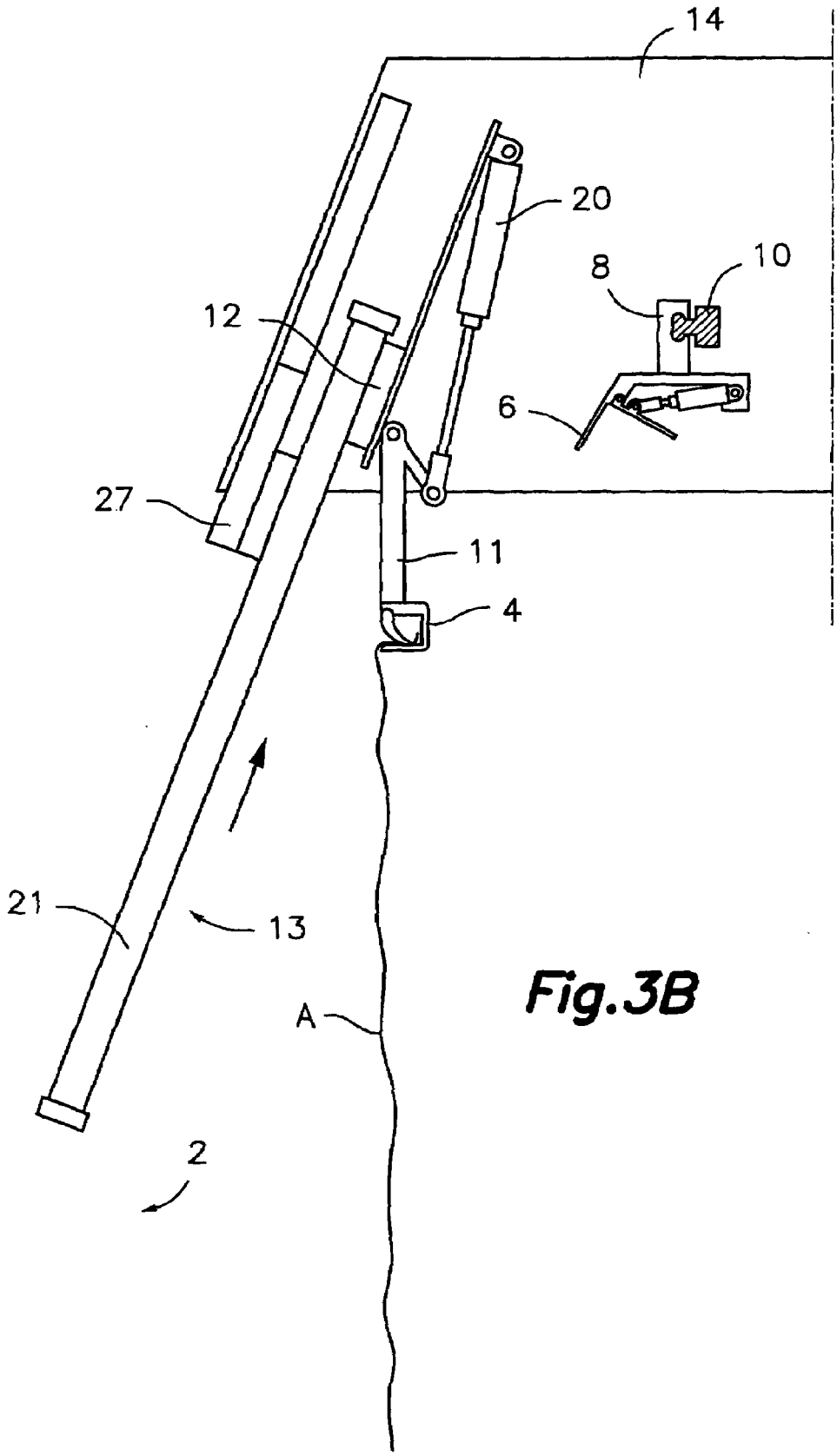
Figure 3C:
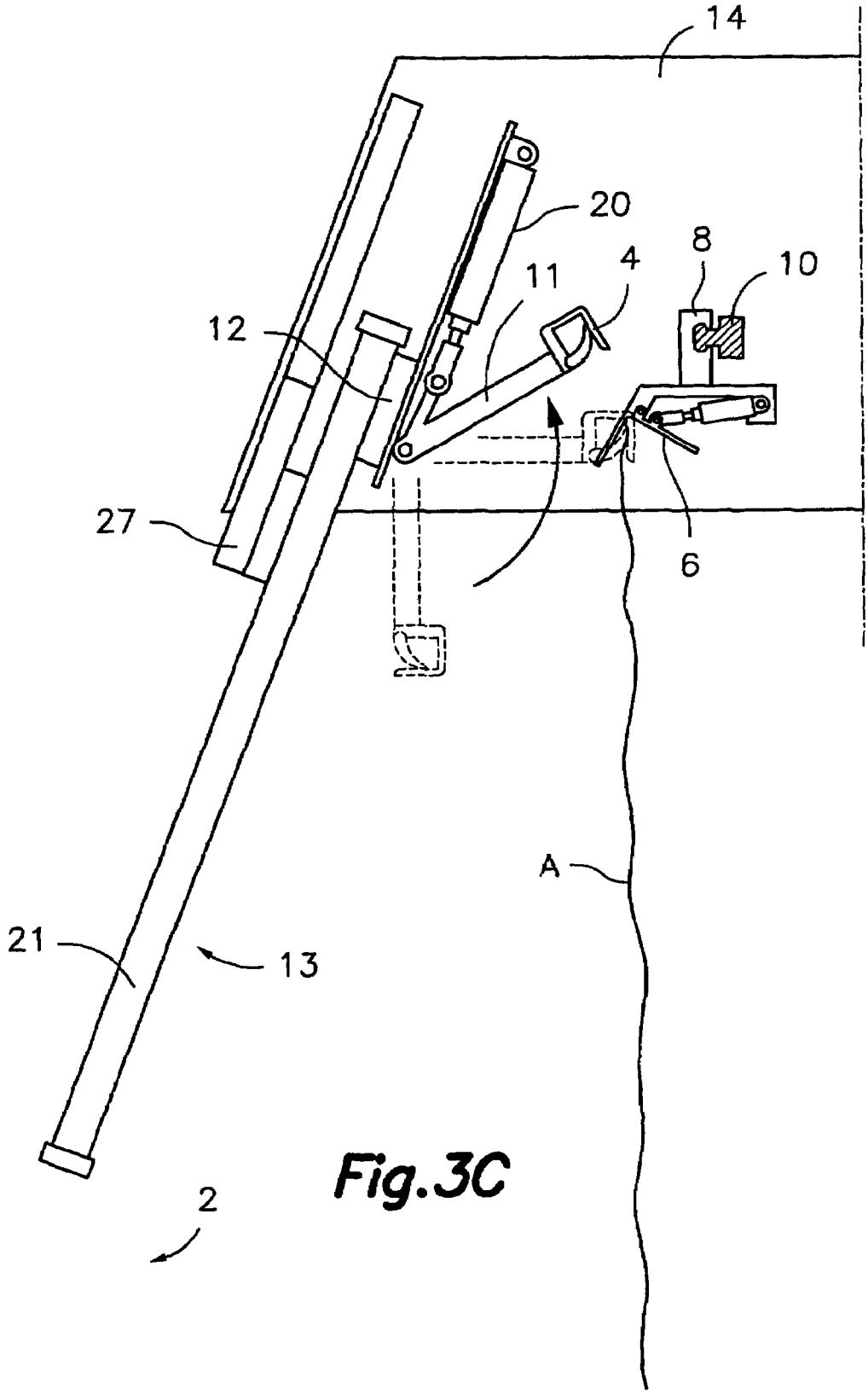
Figure 3D:
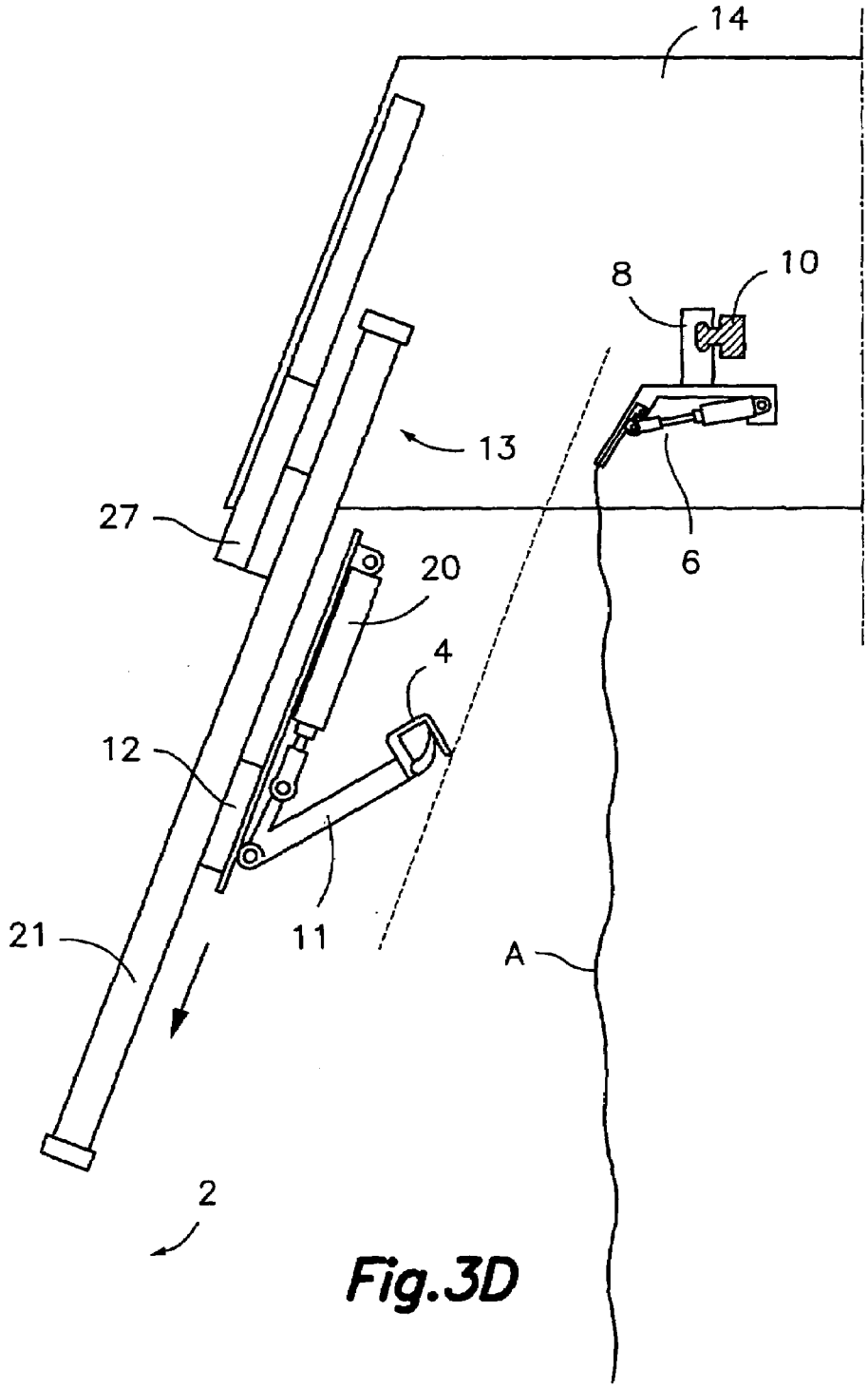

With reference to FIGS. 3A-3D said combined trajectory of the first pair of clamps 3, 4 is described during a loading cycle. In a loading position shown in FIG. 3A, slide 12 is positioned at the lower end of guide 13 and pivoting arm 11 is in an initial position extending downwards. In this loading position, the first pair of clamps 3, 4 (only one of which is shown in FIGS. 3A, 3D) is in a suitable ergonomic position for an operator to be able to comfortably catch two adjacent ends of a flat article of clothing, each in a respective clamp of the first pair of clamps 3, 4. From here, the rotation driving means of pivoting arm 11 and the translation driving means of slide 12 are ready to start, following an order from the operator, a sequence of operations for producing the following movements.

First of all, slide 12 makes a first movement, pivoting arm 11 being in an initial position extending downwards, from a lower or loading position (FIG. 3A) to an upper or transfer position (FIG. 3B). The flat article of clothing A is dragged upwards and hangs vertically. Then, pivoting arm 11 makes a first rotation from the said initial position to a final position extending upwards and inwards (FIG. 3C) while slide 12 remains is said transfer position. It should be noted that this first rotation of the pivoting arm takes place while the second pair of clamps 5, 6 is in a reception position, which is suitably related to the trajectory of the first pair of clamps 3, 4 so that the flat article of clothing A is automatically transferred from the first pair of clamps 3, 4 to the second pair of clamps 5, 6 during said first rotation of pivoting arm 11. The first and second pairs of clamps are driven in a conventional manner during the transfer and the description thereof is omitted.

However, it is characteristic of this invention that the transfer takes place in a predetermined position (indicated in dotted lines in FIG. 3C) during the first rotation of pivoting arm 11, when the pivoting arm has performed only a part of its first rotation. When pivoting arm 11 reaches the final position after the transfer (indicated in solid lines in FIG. 3C), the first pair of clamps 3, 4 reaches a position beyond the position of the second pair of clamps 5, 6. This means that the second pair of clamps 5, 6 can start their movements immediately without having to wait for the first pair of clamps 3, 4 to be removed. As soon as the transfer has been completed, slide 12 can start a second translation movement, in the opposite direction, but maintaining pivoting arm 11 in said final position (FIG. 3D). Thanks to this final position of the pivoting arm, the trajectory of the first pair of clamps 3, 4 (the maximum position of which is indicated by solid lines in FIG. 3D) is free from interferring with the second pair of clamps 5, 6 during said second translation movement of slide 12 from the transfer position to the new loading position. By virtue of this, the second translation movement can be performed irrespective of the position of the second pair of clamps.

Finally, pivoting arm 11 performs a second rotation in the opposite direction, from the final position to the starting position again. This second rotation can be performed during the second translation movement of slide 12 and once the position of the first pair of clamps 3, 4 has passed the position of the second pair of clamps 5, 6, or once slide 12 has reached the loading position, in which case a pressure regulator regulates the operating pressure of a cylinder 20 so that arm 11 and the first pair of clamps 3, 4 cannot harm the operator. It may occur that an operator issues an order to activate the lifting means while the second pair of clamps 5, 6 is busy serving another loading post. In this case, the lifting means can interrupt slide 12 in the transfer position, with pivoting arm 11 in the initial position (FIG. 3B), long enough for the second pair of clamps 5, 6 to adopt the reception position, and then continue with the second rotation of pivoting arm 11 and transfer clothing article A to the second pair of clamps 5, 6 as described above in relation to FIG. 3C.

With the combined translation and rotation trajectory according to this invention a greater overall stroke is achieved for the first pair of clamps 3, 4 in comparison with just a translation or just a rotation movement, and means that the first pair of clamps 3, 4 is located, in the loading position (FIGS. 2 and 3A), further away from reception end 31 of conveyor belt 30, and therefore in a more comfortable, ergonomic position for the operator. According to an exemplary embodiment shown in FIGS. 3A-3D, the rotation driving means of pivoting arm 11 include a fluid dynamics actuator 20, such as a pneumatic cylinder with rod mounted in slide 12 and connected to pivoting arm 11. As an alternative to said pneumatic cylinder with rod, a pneumatic rotary actuator with blades could be used for the same purpose. The translation driving means of slide 12 include a linear fluid dynamic actuator 21, such as a pneumatic cylinder without rod, which also performs the function of rectilinear guide rails 13. However, rectilinear guide rails 13 could be independent and cooperate with another type of linear fluid dynamic actuator with an equivalent result. The translation driving means of slide 12, including rectilinear guide rails 13, are connected to regulating means adapted to move the whole translation driving means ensemble of slide 12 up and down, and with it loading post 2, in order to place the first pair of clamps 3, 4 of loading post 2 at a floor height that is adapted to the height of the operator. Said regulating means include, in the exemplary embodiment shown, a linear fluid dynamic actuator 27, without rod, to which pneumatic cylinder 21 without rod is connected, the latter forming the translation driving means of slide 12. A drive command from said actuator 27 allows the user to conveniently regulate the height of the work post.

Each loading post 2 includes, in a place that the operator can easily access, controls 25 (not shown in FIGS. 3A-3D) including, as well as said height regulating control, a control for activating the driving means for running the loading cycle. This action control is driven by the operator when he has finished manually loading an article of clothing on clamps 3, 4 in his particular loading post 2. Advantageously, the action control includes a photocell that is activated simply by the operator passing his hand above or in front of it, which saves time and reduces operator fatigue. When various operators are working at the same time in various loading posts, the electronic control establishes an order of precedence for consecutively activating the driving means in each case, according to programmed maximum efficiency parameters. This way, the electronic control means control the driving means so that the various first pairs of clamps 3, 4 corresponding to the various loading posts 2 alternate in transferring the corresponding flat articles of clothing to said second pair of clamps 5, 6 (or second pairs of clamps 5, 6, when there are more than one) depending on the order of precedence in which the operators have given the action orders via their respective action controls and finally depending on the maximum efficiency parameters programmed in the control means.

The apparatus includes a suction device 50 having a suction mouth 51 adjacent to a lower part of reception end 31 of conveyor belt 30 in order to attrach the flat article of clothing by means of a suction jet towards said reception end 31 of conveyor belt 30 and towards a longitudinal roller 52 located next to a lower edge of said suction mouth 51. Said longitudinal roller 52 is driven to rotate at a relatively high speed so as to quickly introduce the hanging part of the article of clothing into box 53 of the suction device. This way, as conveyor belt 30 pulls the top part of the article of clothing, the part contained in box 53 is dragged outwards and towards the belt while mobile brushes 28 moving longitudinally in divergent directions next to suction mouth 51 remove any possible wrinkles from the article of clothing.

Figure 2:
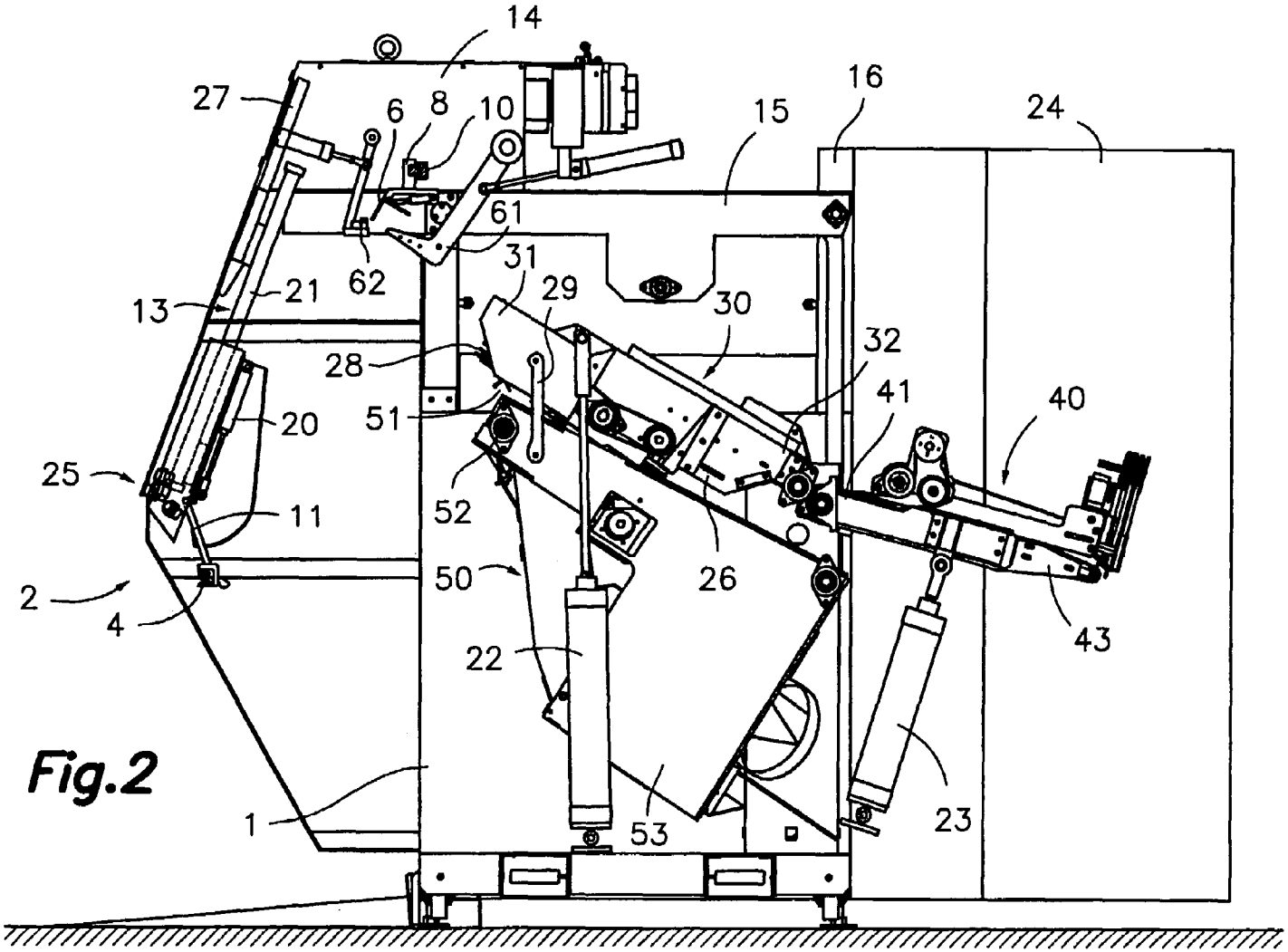
FIG. 2 is a schematic side view showing the apparatus of FIG. 1 in a loading mode suitable for loading flat, large size articles of clothing using the lifting means.

FIGS. 1 and 2 show the apparatus of the invention in a loading mode suitable for loading flat, large size articles of clothing using the lifting means associated with loading posts 2. However, another characteristic of the apparatus of this invention is that it includes a system whereby conveyor belt 30 can be collapsed so that reception end 31 thereof drops to a suitable height for at least one operator to directly and manually load flat, small size articles of clothing.

Figure 4:
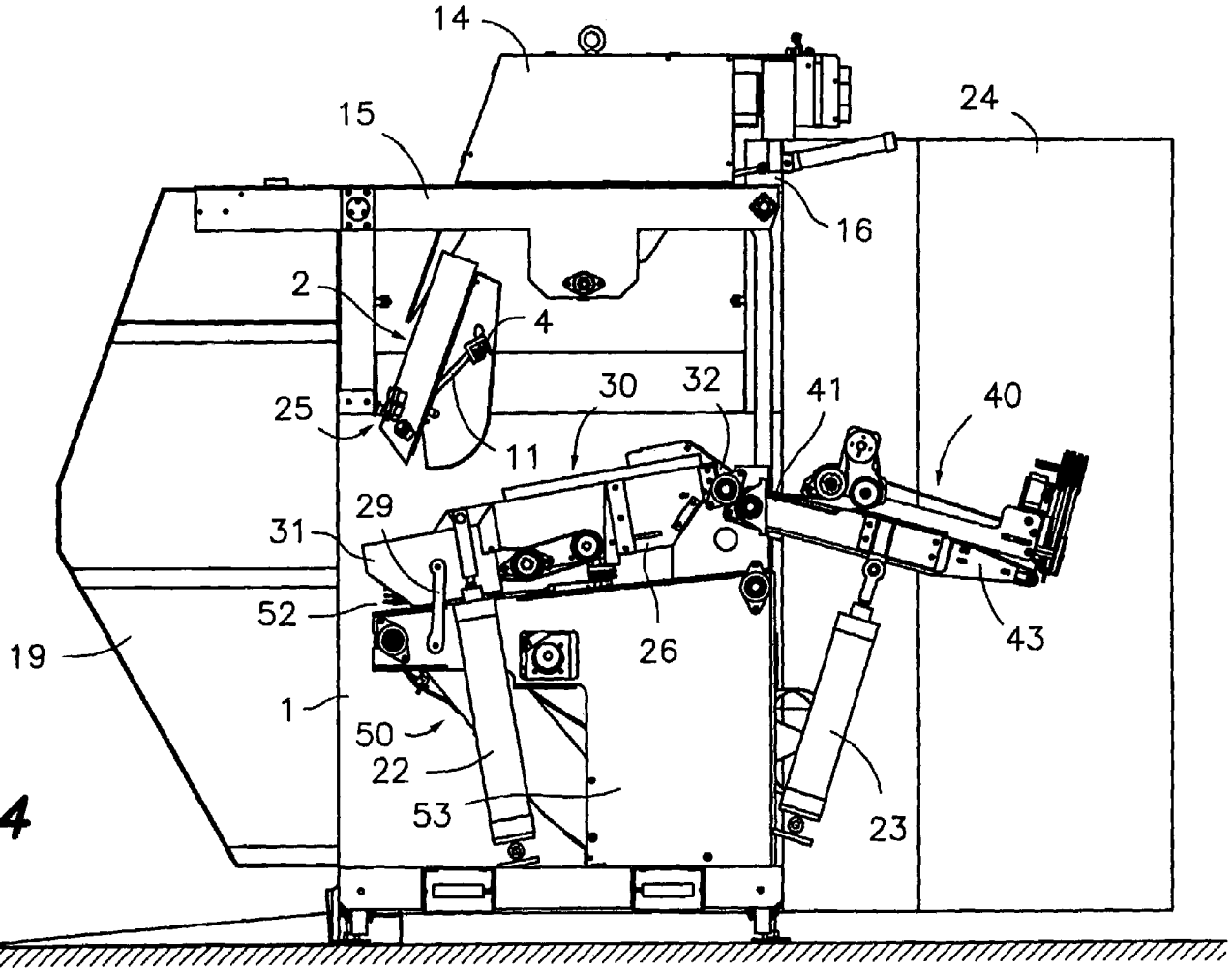
FIG. 4 is a schematic side view showing the apparatus in FIG. 1 in another loading mode suitable for manually loading flat, small size articles of clothing directly onto the reception end of the conveyor belt.

FIG. 4 schematically shows the same apparatus of FIGS. 1 and 2 in said loading mode suitable for manual loading. For this, conveyor belt 30 is mounted on a chassis 26 that is mounted so that it can pivot around an axis in relation to frame 1, and suction device 50 is mounted in a box 53 that is mounted to that it can pivot around another axis, separate from the pivoting axis of conveyor belt 30, in relation to frame 1. Between chassis 26 of conveyor belt 30 and box 53 of suction device 50 linking means are included for releasably linking a pivoting movement of chassis 26 of conveyor belt 30 to a pivoting movement of box 53 of suction device 50 maintaining a relative, suitable position between reception end 31 and suction mouth 51. Said linking means can, for example, be made up of connecting rods 29.

Driving means 22, such as, for example, fluid dynamic cylinders, are adapted to pivot conveyor belt 30. When said linking means are activated, the pivoting action of the conveyor belt causes suction device 50 to perform a corresponding pivoting action in order to alternate between the automatic loading mode (FIG. 2), wherein reception end 31 is at a suitable height for loading flat, large size articles of clothing using lifting and spreading out means, and the manual loading mode (FIG. 4) wherein reception end 31 is at a suitable height for at least one operator to directly load flat, small size articles of clothing.

However, when the linking means are deactivated, in other words, when connecting rods 29 are disconnected, driving means 22 only cause conveyor belt 30 to pivot independently of suction device 50. This way the apparatus can adopt a maintenance mode (not shown) wherein conveyor belt 30 is in a position where its reception end is lifted as high as possible while the front end of suction device 50 is in its lowest position to provide access to the lower part of conveyor belt 30 and to the upper part of suction device 50 for cleaning and maintenance purposes.

Said pivoting axis of chassis 26 lies at a rear end thereof, near a delivery end 32 of conveyor belt 30. Fluid dynamics cylinders 22 connect the front end of chassis 26 to frame 1, whereby an extension or withdrawal of fluid dynamic cylinders 22 causes chassis 26 to tilt with the whole ensemble of conveyor belt 30 so that delivery end 32 remains substantially in the same place. Also, loading posts 2 and spreading out means 5, 6, 7, 8 are mounted on a mobile support structure 14 slidably mounted with respect to said frame 1 and associated with movement means, for example, an electric motor or fluid dynamic cylinders, enabling loading posts 2 and spreading out 5, 6, 7, 8 to move backwards beyond reception end 31 of conveyor belt 30, and above same, when reception end 31 is collapsed. With this, the entrance to the apparatus is kept clear without interference from loading posts 2 when it is desired to perform a manual loading operation. In addition, the apparatus includes retracting means allowing loading posts 2 to be retracted upwards, in the direction of rectilinear guide rails 13, until a lower end of the loading posts is arranged above reception end 31 of conveyor belt 30, when said end is collapsed in the manual loading mode, in order to provide enough space for an operator to be able to comfortably position, arrange and see a flat article of clothing on conveyor belt 30. Said retracting means can be provided by the same linear fluid dynamic actuator 27, without rod, which activates the above-mentioned height regulating means of the first pair of clamps 3, 4 with respect to the floor, or by a specific dedicated actuator.

As usual, the apparatus includes an exit conveyor belt 40 having a reception end 41 arranged to receive flat articles of clothing from delivery end 32 of conveyor belt 30 and a delivery end adapted to load flat, conveniently spread out articles of clothing into a laundry processing unit, such as an ironing or folding machine serially connected to the apparatus. As mentioned, delivery end 32 remains in the same position when conveyor belt 30 is collapsed, which facilitates the permanent link with reception end 41 of exit conveyor belt 40.

Figure 5:
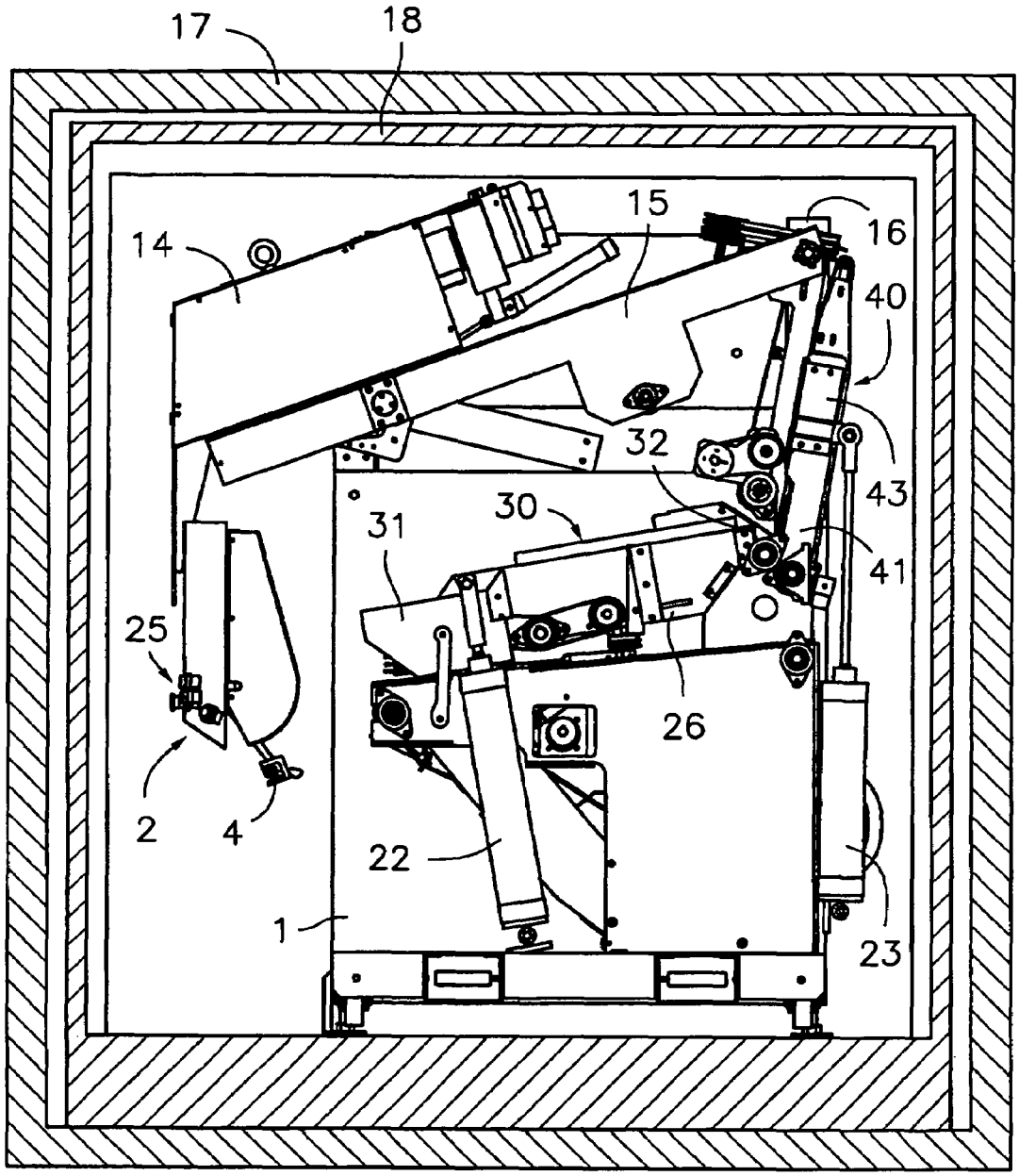
FIG. 5 is a schematic side view showing the apparatus in FIG. 1 in a transport mode suitable for positioning the apparatus in a packaging inside a standard container.

Said mobile support structure 14 is mounted on a top chassis 15 articulated with respect to a structural element 16 of frame 1. Said top chassis 15 can be collapsed so that mobile support structure 14 drops downwards and loading posts 2 withdraw inwards, as shown in FIG. 5, which reduces the overall volume of the apparatus. Since the rotation driving of top chassis 15 is only performed occassionally, dedicated driving means have not been provided, but instead the same fluid dynamic cylinders 22 used to drive chassis 26 of conveyor belt 30 are used, by temporarily using connecting rods or bars (not shown) between chassis 26 and top chassis 15.

Moreover, exit conveyor belt 40 is also installed in a rear chassis 43 that is mounted to that it can pivot around an axis in relation to frame 1. Said pivoting axis of rear chassis 43 of exit conveyor belt 40 is near to said reception end 41, whereby reception end 41 does not substantially vary its position when exit conveyor belt 40 is pivoted. Pivoting driving means 23 make it possible to move rear chassis 43 of exit conveyor belt 40 between an operating position, extending outwards, and a folded position, backing on to the rear part of frame 1, which folded position, as well as providing access to a laundry processing unit connected on-line to the apparatus exit, reduces the overall volume of the apparatus. This way, a collapsed position of said top chassis 15 of frame 1 together with a folded position of exit conveyor belt 40, and additionally dismantling some cowling elements 19, 24, provides an apparatus volume that is suitable for being packaged in a box 17 of degradable or reuseable material, such as wood, said box 17 being adapted to be placed into a standard container 18, as shown in FIG. 5. This makes it possible to transport the apparatus in a conventional manner without having to use special transport, and to install the apparatus in a relatively easy and quick manner in the final destination, simply by changing the various modular units from their folded positions to their operating positions.

For greater working flexibility, the conveyor belt optionally includes two parallel conveyor belts, or more commonly two units of parallel conveyor belts associated with independent driving means or at least provided with independent transmissions. The control means are adapted to activate together the driving of both belts or belt units to transport flat, large size articles of clothing to a central position, or to independently activate the driving of one or another belt or belt unit to transport flat, medium or small size articles of clothing on each of said belts or belt units. The above characteristic makes full sense when the apparatus includes four loading posts 2 and two pairs of second clamps 5, 6 mounted on respective pairs of carriages 7, 8 arranged to run on transversal guide rail 10. In this case, a pair of second clamps 5, 6 is adapted to serve two of said loading posts 2 located at the right of the appparatus and the other pair of second clamps 5, 6 is adapted to serve the other two loading posts 2 located at the left of the apparatus. Advantageously, detection means are arranged to detect the size of the article of clothing held by each of the second pairs of clamps 5, 6 and the control means are adapted to activate the drive mechanism of the belts or belt units of conveyor belt 30, as a whole or independently, depending on the result of said detection.

In order to facilitate the operator's task in the manual loading mode, the apparatus includes one or more connected control boxes for issuing orders to a laundry processing unit connected on line to the apparatus exit. Said control box or boxes are arranged in chassis 26 of conveyor belt 30, near reception end 31, in a position or positions suitable for not interferring with any action or mechanisms when conveyor belt 30 is in said automatic loading mode, and for remaining comfortably at the disposition of the operator or operators when conveyor belt 30 is in said manual loading mode. This way, an operator can, for example, give different types of folding orders to a folding machine connected on line to the apparatus exit depending on the type of article of clothing spread out on conveyor belt 30, or that the article is not folded when an abnormal situation is detected, such as for example a stain.

The apparatus according to this invention described above allows a new method to be implemented for loading flat articles of clothing into a laundry processing unit, such as an ironing or folding machine. The method includes, as is usual, the steps of manually catching the ends of a flat article of clothing in a first pair of clamps 3, 4 arranged in at least one loading post 2 controlled by an operator; moving said first pair of clamps 3, 4 to a higher position using lifting means associated with said loading post 2; transferring the flat article of clothing to a second pair of clamps 5, 6 associated with spreading out means including at least one pair of carriages 7, 8 running on respective guide rails 9, 10 transversal to the transport direction of said conveyor belt 30; spreading out the flat article of clothing by independently moving the pair of carriages 7, 8 carrying the second pair of clamps 5, 6, separating them from one another, between positions in front of loading post 2, of which there is at least one, and suitable positions with respect to the centre of conveyor belt 30; and placing one end of the flat, spread out article of clothing on said receptionend 31 of conveyor belt 30 with the help of blowing means. The method of this invention is characterised in that the said step of moving the first pair of clamps 3, 4 to a higher position using said lifting means includes moving the first pair of clamps 3, 4 in a combined translation and rotation trajectory by means of at least one rotation, driven by rotation driving means, of at least one pivoting arm 11 supporting at one end the first pair of clamps 3, 4; and at least one translation movement, driven by translation driving means, of a slide 12 slidably mounted on rectilinear guide rails 13 and to which pivoting arm 11 is connected at its other end. The steps following this combined translation and rotation trayectory correspond to the positions of clamps 3, 4 described above in relation to FIGS. 3A-3D.

The described and illustrated exemplary example is merely illustrative and non-limiting, and those skilled in the art will be able to introduce changes and modifications thereto without departing from the scope of this invention as defined in the attached claims.

The invention claimed is:

1. An apparatus for loading flat articles of clothing into a laundry processing unit, comprising a frame having an entrance opposite a reception end of a conveyor belt, at least one loading post controlled by an operator, said loading post having a first pair of clamps in which said operator can catch the ends of a flat article of clothing, and lifting means adapted to move said first pair of clamps to a higher position in which the flat article of clothing is transferred to a second pair of clamps associated with spreading out means including at least one pair of carriages running on respective guide rails transverse to the transport direction of said conveyor belt, each clamp in said second pair of clamps being mounted on one respective carriage of said pair of carriages, driving means being arranged to independently move said pair of carriages separating them from one another between positions in front of said at least one loading post, and symmetrical positions with respect to the center of conveyor belt for placing an end of the flat article of clothing spread out on said reception end of conveyor belt with the help of blowing and suction means, characterized in that said lifting means for moving said first pair of clamps in the loading post include at least one pivoting arm supporting at one end the first pair of clamps and which is connected in a pivoting manner at the other end to a slide slidably mounted on one or more rectilinear guide rails having one end higher than the other, rotation driving means for said pivoting arm and translation driving means for said slide being arranged and adapted to move the first pair of clamps in a combined translation and rotation trajectory.

2. The apparatus, according to claim 1, wherein said rotation driving means for said pivoting arm and said translation driving means for said slide are adapted to produce, in a loading cycle:

- a first translation movement of said slide, with said pivoting arm in a downwards extending initial position, from a lower or loading position to an upper or transferring position;
- a first rotation of said pivoting arm from said initial position to an upwards and inwards extending final position while said slide remains in said transfer position and the second pair of clamps is in a reception position suitably related to the trajectory of the first pair of clamps for automatically transferring the flat article of clothing from the first pair of clamps to the second pair of clamps during said first rotation of said pivoting arm, the position of the first pair of clamps being beyond the position of the second pair of clamps when said pivoting arm is in said final position after the transfer;
- a second translation movement of said slide, with said pivoting arm in said final position, from the transfer position to the loading position again, with the trajectory of the first pair of clamps being free from interfering with the second pair of clamps during the second translation movement of said slide; and
- a second rotation of said pivoting arm in an opposite direction from the final position to the initial position again during said second translation movement of said slide or when said slide has reached said loading position again.

3. The apparatus, according to claim 2, wherein said rotation driving means of said pivoting arm and said translation driving means of said slide are adapted to stop said slide in the transfer position and with said pivoting arm in the initial position for enough time allowing the second pair of clamps to adopt said reception position.

4. The apparatus, according to claim 1, further comprising regulating means adapted to move the translation driving means of said slide and said loading post associated thereof upwards and downwards to place the first pair of clamps of said loading post at a floor height adapted to the height of different operators.

5. The apparatus, according to claim 1, wherein said at least one loading post, includes controls available to the operator including an activation control for activating the driving means for performing a loading cycle.

6. The apparatus, according to claim 5, wherein said activation control includes a photocell adapted so that it is activated by the operator passing his hand in front of it.

7. The apparatus, according to claim 5, wherein it includes various of said loading posts, each controlled by an operator, and one or more second pairs of clamps, electronic control means being provided to control the driving means so that the various first pairs of clamps corresponding to the various loading posts alternate in transferring corresponding flat articles of clothing to said one or more second pairs of clamps depending on the orders given by the operators by means of said action controls.

8. The apparatus, according to claim 1, further comprising a suction device having a suction mouth adjacent to a lower part of said reception end of said conveyor belt for attracting the flat article of clothing by means of a suction jet towards said reception end, a longitudinal roller being arranged next to a lower edge of said suction mouth and driven to rotate at a relatively high speed so as to introduce the hanging part of the flat article of clothing in a box of said suction device.

9. The apparatus, according to claim 8, wherein said conveyor belt is installed on a chassis mounted to that it can pivot around an axis in relation to said frame, and said box of said suction device is mounted so that it can pivot around another axis in relation to said frame, linking means being included to link in a releasable manner a pivoting action of said chassis of said conveyor belt with a pivoting action of said box of said suction device maintaining a relative suitable position between said reception end and said suction mouth.

10. The apparatus, according to claim 9, further comprising driving means adapted to pivot said conveyor belt together with said suction device when said linking means are activated so as to change between an automatic loading mode, where said reception end is at a suitable height for loading flat, large size articles of clothing using the lifting and spreading out means, and a manual loading mode where said reception end is at a suitable height for at least one operator to directly load flat, small size articles of clothing.

11. The apparatus, according to claim 10, wherein said driving means are adapted to pivot said conveyor belt independently from said suction device when said linking means are deactivated so as to provide access to the lower part of said conveyor belt and to the top part of said suction device for cleaning and maintenance purposes.

12. The apparatus, according to claim 11, wherein said linking means include at least one connecting rod between said chassis of said conveyor belt and said box of said suction device.

13. The apparatus, according to claim 10, wherein said linking means include at least one connecting rod between said chassis of said conveyor belt and said box of said suction device.

14. The apparatus, according to claim 10, wherein said loading posts and spreading out means are mounted on a mobile support structure slidably mounted with respect to said frame and associated with said driving means for moving together said loading posts and said spreading out means so as to change between said automatic loading mode, where loading posts are separated from said reception end of said conveyor belt and comfortably accessible to the operators, and said manual loading mode, where said loading posts are further behind said reception end of said conveyor belt, and above same, when said reception end is collapsed and is comfortably accessible to the operator or operators.

15. The apparatus, according to claim 14, further comprising retracting means allowing said loading posts to be retracted upwards in the direction of said rectilinear guide rails to place a lower end of the loading posts at a respective height to reception end of said conveyor belt, when the latter is collapsed in the manual loading mode, enough to allow an operator to comfortably place, arrange and see a flat article of clothing on said conveyor belt.

16. The apparatus, according to claim 14, further comprising an exit conveyor belt having a reception end arranged to receive flat articles of clothing from a delivery end of said conveyor belt, said pivoting axis of said chassis of said conveyor belt being near said delivery end whereby said delivery end substantially does not vary its position when said conveyor belt is pivoted.

17. The apparatus, according to claim 16, wherein said exit conveyor belt together with its driving means is installed on a rear chassis mounted to that it can pivot around an axis in relation to said frame, said pivoting axis of said rear chassis of said exit conveyor belt being near said reception end whereby said reception end substantially does not vary its position when said exit conveyor belt is pivoted.

18. The apparatus, according to claim 17, wherein said rear chassis of said exit conveyor belt is associated with pivoting driving means making it possible to change between an operating position and a position backing onto the rear part of said frame to provide access to a laundry processing unit for cleaning and maintenance purposes and to reduce the overall volume of the apparatus.

19. The apparatus, according to claim 18, wherein said mobile support structure is mounted on a top chassis of said frame articulated to a structural element of said frame, whereby said top chassis can be collapsed together with said mobile support structure and said loading posts to reduce the overall volume of the apparatus.

20. The apparatus, according to claim 19, wherein a folded position of said rear chassis, together with a collapsed position of said top chassis of said frame and dismantling at least one cowling element, provides the apparatus with a transport mode that is suitable for being packaged in a box, of degradable or reusable material selected from a group including wood, adapted to be introduced into a standard container.

21. The apparatus, according to claim 10, wherein said conveyor belt includes two parallel conveyor belts or two parallel conveyor belt units associated with driving means controlled so that they are activated together, to transport flat, large size articles of clothing in a central position, or independently, to transport flat, medium or small size articles on each of said belts or belt units.

22. The apparatus, according to claim 10, further comprising one or more control boxes for giving orders to a laundry processing unit connected to the apparatus exit, said control box or boxes being arranged on said chassis of said conveyor belt, near said reception end, in a position or positions suitable for not interfering when said conveyor belt is in said automatic loading mode, and remaining comfortably at the disposition of the operator or operators when said conveyor belt is in said manual loading mode.

23. The apparatus according to claim 1, wherein various apparatus operating systems are grouped in different modules mounted on respective chassis adapted to produce relative movements and to adopt different positions with respect to said frame in order to provide at least one operating mode, suitable for loading articles of clothing, and at least one transport mode, suitable for providing an overall reduced volume appropriate for transporting the apparatus and in that at least loading posts and spreading out means form one module mounted on a top chassis which is articulated to a structural element of said frame and can be pivoted between an operating position and a collapsed position suitable for reducing the overall volume of the apparatus.

24. The apparatus according to claim 23, further comprising an exit conveyor belt which, together with its driving means forms a module installed on a rear chassis mounted in a pivoting manner with respect to said frame and associated with pivoting means which make it possible to change between an operating position and a folded position backing onto the rear part of frame, said folded position providing access to a laundry processing unit for cleaning and maintenance and a reduction in the overall volume of the apparatus.

25. The apparatus according to claim 1, wherein the laundry processing unit is an ironing machine or a folding machine.

26. A method for loading flat articles of clothing into a laundry processing unit, including an entrance opposite a reception end of a conveyor belt, the method comprising:

manually catch the ends of a flat article of clothing in a first pair of clamps arranged in at least one loading post controlled by an operator;

move said first pair of clamps to a higher position using lifting means associated with said loading post;

transfer the flat article of clothing to a second pair of clamps associated with spreading out means including at least one pair of carriages running on respective guide rails transverse to the transport direction of said conveyor belt, each clamp in said second pair of clamps being mounted on one respective carriage of said pair of carriages;

spread out the flat article of clothing by independently moving, via driving means, the pair of carriages separating them from one another between positions opposite said at least one loading post, and a symmetrical position with respect to the center of said conveyor belt; and place one end of the flat article of clothing spread out on said reception end of said conveyor belt with the help of blowing and suction means, characterized in that said step of moving the first pair of clamps to a higher position using said lifting means includes moving the first pair of clamps in a combined translation and rotation trajectory by means of:

at least one rotation, produced by rotation driving means, of at least one pivoting arm supporting on one of its ends the first pair of clamps; and at least one translation movement, produced by translation driving means, of a slide slidably mounted on rectilinear guide lines and to which said pivoting arm is connected at its other end.

27. The method, according to claim 26, wherein said movement of the first pair of clamps in a combined translation and rotation trajectory includes, in a loading cycle, comprises:

a first translation movement of said slide, with said pivoting arm in an initial position extended upwards, from a lower or loading position to an upper or transfer position;

a first rotation of said pivoting arm from said initial position to a final position extended upwards and inwards while said slide remains in said transfer position and the second pair of clamps is in a reception position suitably related to the trajectory of the first pair of clamps for an automatic transfer of the flat article of clothing from the first pair of clamps to the second pair of clamps during said first rotation of said pivoting arm, the position of the first pair of clamps being beyond the position of the second pair of clamps when said pivoting arm is in the final position after the transfer;

a second translation movement of said slide, with said pivoting arm in said final position, from the transfer position to the loading position again, the trajectory of the first pair of clamps being free from interfering with the second pair of clamps during said second translation movement of slide; and a second rotation of said pivoting arm in the opposite direction from the final position to the initial position again during said second translation movement of said slide or when said slide has reached said loading position again.

28. The method, according to claim 27, wherein said rotation driving means of said pivoting arm and said translation driving means of said slide are controlled in order to stop said slide in the transfer position and with said pivoting arm in the initial position long enough for the second pair of clamps to adopt said reception position.

29. The method according to claim 26, wherein the laundry processing unit is an ironing machine or a folding machine.

* * * * *